US005494235A

United States Patent [19]

Vowles

[11] Patent Number: 5,494,235

[45] Date of Patent: Feb. 27, 1996

[54] APPARATUS FOR PROJECTING DEVICES THROUGH TUBES AND CONDUITS

[75] Inventor: Robert W. Vowles, North Welbourne, Australia

[73] Assignee: Barry Bros. Specialised Services Pty. Ltd., Victoria, Australia

[21] Appl. No.: 50,035

[22] PCT Filed: Oct. 31, 1991

[86] PCT No.: PCT/AU91/00504

§ 371 Date: Jun. 8, 1993

§ 102(e) Date: Jun. 8, 1993

[87] PCT Pub. No.: WO92/07786

PCT Pub. Date: May 14, 1992

[30] Foreign Application Priority Data

Oct. 31, 1990 [AU] Australia ..... Pk3105

[51] Int. Cl.[6] ..... B65H 75/48; B65H 75/14; A62C 35/00

[52] U.S. Cl. ..... 242/390.3; 242/397.3; 242/407; 242/602.1; 242/615.3; 242/158.5; 137/355.2; 137/355.26

[58] Field of Search ..... 242/54 R, 86, 242/86.1, 86.2, 117, 158.5, 397, 397.2, 397.3, 407, 390.3, 602.1, 602.2, 615.1, 615.3, 615.4; 137/355.2, 355.12, 355.26; 187/259, 261

[56] References Cited

U.S. PATENT DOCUMENTS

| | | | |
|---|---|---|---|
| 1,433,412 | 10/1922 | Playle | 242/158.1 |
| 1,850,677 | 3/1932 | Kieneman | 242/388.1 |
| 2,309,574 | 1/1943 | Busha | 242/377 |
| 4,066,093 | 1/1978 | Egerstrom | 242/390.3 |
| 4,660,782 | 4/1987 | Hegemann | 242/386 |
| 4,767,073 | 8/1988 | Malzacher | 242/414 |

FOREIGN PATENT DOCUMENTS

| | | | |
|---|---|---|---|
| 159022 | 3/1953 | Australia | 88.1 74.5 |
| 204922 | 3/1956 | Australia | 88.1 74.5 |
| 241131 | 10/1960 | Australia | 88.1 74.5 |
| 492617 | 2/1930 | Germany . | |
| 2823024 | 3/1978 | Germany | B65H 75/38 |
| 1299162 | 12/1972 | United Kingdom . | |
| 2199304 | 7/1988 | United Kingdom | B65H 73/40 |

OTHER PUBLICATIONS

Patent Abstracts of Japan, M–1015, p. 147, JP,A, 2–147574 (Jun. 6, 1990).

Patent Abstracts of Japan, M–776, p. 82, JP.A. 63–202569 (Aug. 22, 1988).

*Primary Examiner*—John Q. Nguyen

*Attorney, Agent, or Firm*—Ernest V. Linek

[57] ABSTRACT

An apparatus for storing a flexible lance whereby the lance may be projected from the apparatus and into and through a tube to be cleaned or surveyed, the apparatus comprising a storage drum with a peripheral helical groove into which a lance is placed in a plurality of wound coils for storage purposes, the lance being projected from the drum by rotating same and at the same time passing the lance through a guide member that is permitted to move axially in response to rotational movement of the drum, the lance being retained in the groove in the storage position by a plurality of axially extending rollers spaced circumferentially around the drum.

8 Claims, 2 Drawing Sheets

APPARATUS FOR PROJECTING DEVICES THROUGH TUBES AND CONDUITS

FIELD OF THE INVENTION

The present invention relates to improvements in apparatus for cleaning or otherwise working on tubes and conduits.

BACKGROUND OF THE INVENTION

U.S. Pat. No. 5,002,120 discloses an arrangement wherein a flexible hose is stored on a rotatable drum in a limited number of turns whereby the drum is rotated to extend the hose through a rigid laterally disposed and substantially straight guide or housing. The hose is connected to a plurality of separate or individual lances each having a length approximating the length of the rigid guide or housing such that when the hose is withdrawn onto the drum, the individual lances are substantially withdrawn into the guide or housing. The arrangement disclosed is intended to enable a plurality of lances to be moved through conduits or pipes to be cleaned simultaneously. The disadvantage with the disclosed system is that the exit point for the hose from the drum is fixed thereby substantially limiting the length of hose that might be stored on the drum and as a result limiting severely the possible length of movement of travel of each of the lances. Moreover a quite large length of head room is required in front of any bundle or array of tubes to be cleaned to enable positioning of the equipment if the tubes are to be cleaned in situ as would be desired in most circumstances. If this required head room is unavailable in any existing installation, then the tubes could not be cleaned with this equipment without removing same from the position in which they are installed.

Another arrangement is disclosed in Patent Cooperation Treaty Application No. PCT/AU90/00126 which discloses apparatus for projecting devices through tubes and conduits, said apparatus comprising a drum captured within a cage of axially disposed rollers and provided with a spiral groove on its outer surface, said drum being rotatable by drive means to extend from or retract back into said groove a cleaning lance, umbilical cable for a survey unit or the like, said drum being axially displaced during rotation to maintain the point at which said lance, umbilical cable or the like exits from or re-enters said groove in alignment with a tangentially arranged guide tube.

The aforesaid arrangement has worked satisfactorily but it has been found desirable to make some practical modifications to the system to improve its simplicity and portability. This arrangement involves both axially and rotationally moving the drum and flexible lance or umbilical cable or the like which requires considerably larger power units to drive the system and involves the use of more power in operation. Moreover, the system, because of this complication is larger and more complicated than might be otherwise needed.

The objective therefore of the present invention is to provide apparatus which is capable of projecting a stiffly flexible elongated member through a conduit, tube or the like which requires a minimum of space in front of the conduit, tube or the like being worked upon, but which is relatively simple in construction.

SUMMARY OF THE INVENTION

Accordingly, the present invention provides apparatus for storing and selectably projecting a flexible lance therefrom, said apparatus comprising a storage means for storing said lance in a plurality of wound coils thereon with a distal end of said lance being adapted to project from said apparatus, drive means enabling rotation of said storage means about a rotation axis to extend said distal end from said storage means or to retract said distal end towards said storage means, said apparatus being characterised in that during rotation of said storage means, the point of exit or return of said lance from or to said apparatus moves in an axial direction.

Conveniently, guide means may be provided through which the lance passes during projection from or withdrawal onto said storage means, said guide means being arranged to move axially. Preferably movement control means may be provided to positively move the guide means in direct response to rotational movement of said storage means to maintain substantial alignment with said lance as the lance leaves or returns onto said storage means. Preferably the guide means may be mounted to the apparatus in a manner restraining same to only move in a direction parallel to said rotation axis, said storage means including an outwardly open helical groove adapted to house said lance when said lance is stored on said storage means, said guide means including a part adapted for location in said groove whereby upon said storage means being rotated said guide means is thereby moved axially.

It has been discovered that an operator can guide a flexible lance or similar elongated element to the conduit to be cleaned or worked upon and it is not therefore absolutely necessary for the lance or other similar flexible elongated element to exit from its storage device constantly at one point, in line with the tube or conduit through which it is to pass. More particularly by permitting the lance and its said guide means to move axially, the apparatus may be made relatively compact and positioned in limited head space to enable most tube arrays to be worked on in situ. Further, by providing an arrangement where at least three and preferably at least five wound coils of lance are provided on the storage drum, there is achieved an adequate extension length for a wide variety of applications. Finally, the aforesaid arrangements make it possible to produce a lighter, simpler device for projecting a flexible lance or the like, which may, if desired be portably constructed. In such a structure, the apparatus would include transport means such as wheels and a housing to accommodate valves and the like necessary for control of the apparatus.

Throughout this specification including the accompanying claims, the term "lance", unless some contrary meaning appears from the context of usage, is intended to mean a stiffly flexible elongated member of any configuration (solid or hollow) adapted to pass through any tube, conduit or the like.

In a further preferred aspect, the present invention provides apparatus for storing and selectably projecting a flexible lance therefrom, said apparatus comprising a storage means for storing said lance in a plurality of wound coils thereon with a distal end of said lance being adapted to project from said apparatus, drive means enabling rotation of said storage means about a rotation axis to extend said distal end from the storage means or to retract said distal end towards said storage means, said apparatus being characterised in that axially extending restraining means are disposed around said storage means to retain said plurality of wound coils on said storage means, said restraining means comprising at least two sections with one of said sections being selectably movable from a first position engaging said wound coils on the storage means to a second position substantially spaced from said storage means. This enables the storage means to be removed from the apparatus for servicing or any other purpose.

In a still further preferred aspect, the present invention provides apparatus for storing and selectably projecting a flexible lance therefrom, said apparatus comprising a storage means for storing said lance in a plurality of wound coils thereon with a distal end of said lance being adapted to project from said apparatus, drive means enabling rotation of said storage means about a rotation axis to extend said distal end from the storage means or to retract said distal end towards said storage means, said apparatus being characterised in that said apparatus further includes a guide means through which said lance passes as it leaves said storage means, said guide means including at least one zone adapted to flex whereby the distal end of said lance can be directed to a plurality of different positions.

In a particularly preferred embodiment of the present invention, the storage means is formed as a drum and is provided with a spiral groove formed on its outer surface. The groove preferably has sufficient depth to just accommodate the lance, umbilical cable or the like. The drum is conveniently rotatably supported within a cage of axially disposed rollers which act to imprison said lance, umbilical cable or the like within said groove formed in said drum. That part of the drum incorporating said groove may be made of a suitable stiff elastomeric material and the width of said groove is made such that said lance, umbilical cable or the like is frictionally captured within said groove when it is rolled into said groove by the action of one or more of said rollers and is thus restrained from circumferential movement relative to said drum. Drive means are connected to said drum to enable it to be driven in a rotational sense and control means are conveniently provided to allow precise control of the rotational movement of said drum. The roller cage may be made in two pans, each of which, in the preferred embodiment, encloses more or less half of the circumference of said drum and each of said parts is openable to allow removal or replacement of said drum from said apparatus. A terminal block may be provided slidably supported on one or more axially disposed rails fixed to the structure of said apparatus outside of said roller cage and upon which is supported the proximal end of the guide tube. Said lance, umbilical cable or the like may be led from said drum out through a bore in said terminal block and thence to said guide tube. Said terminal block may be provided with a tongue projecting radially inwards to engage said groove in said drum such that rotation of said drum causes said terminal block to be axially displaced along said rails and thus maintained in alignment with the point at which said lance, umbilical cable or the like exits from or re-enters said groove in said drum. Said roller cage supporting said drum and said drum drive means are supported in a structure incorporating wheels for ease of movement and provided with a housing to accommodate valves and the like necessary for operation of the unit.

BRIEF DESCRIPTION OF THE DRAWINGS

The nature of the present invention and its aspects will be more readily understood by reference to the following brief description of a preferred embodiment illustrated in the accompanying drawings, in which.

DETAILED DESCRIPTION OF THE PREFERRED EMBODIMENTS

Figure 1:
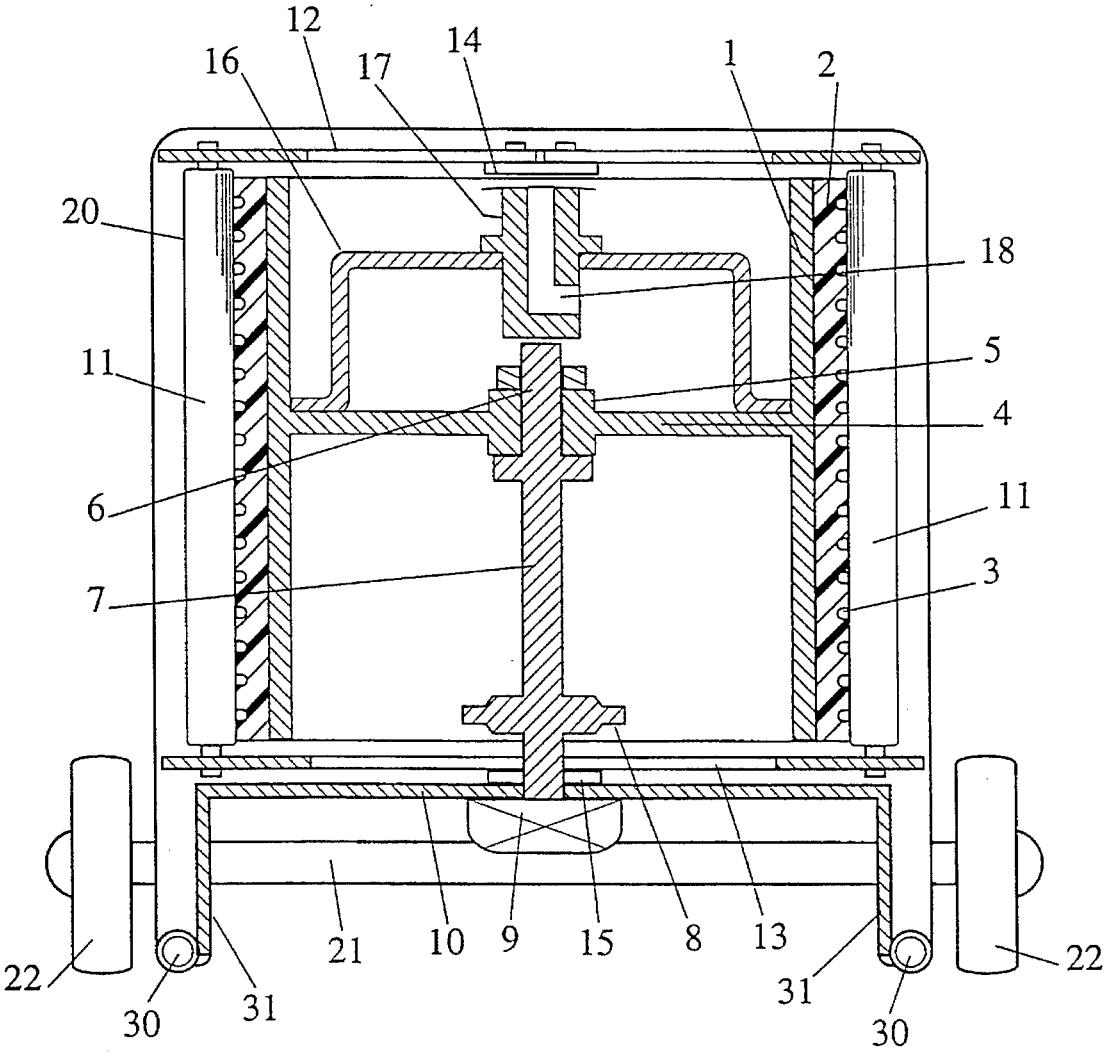
FIG. 1 is a plan view of apparatus in which certain pans of the drum and its support and drive means have been sectioned.
Figure 2:
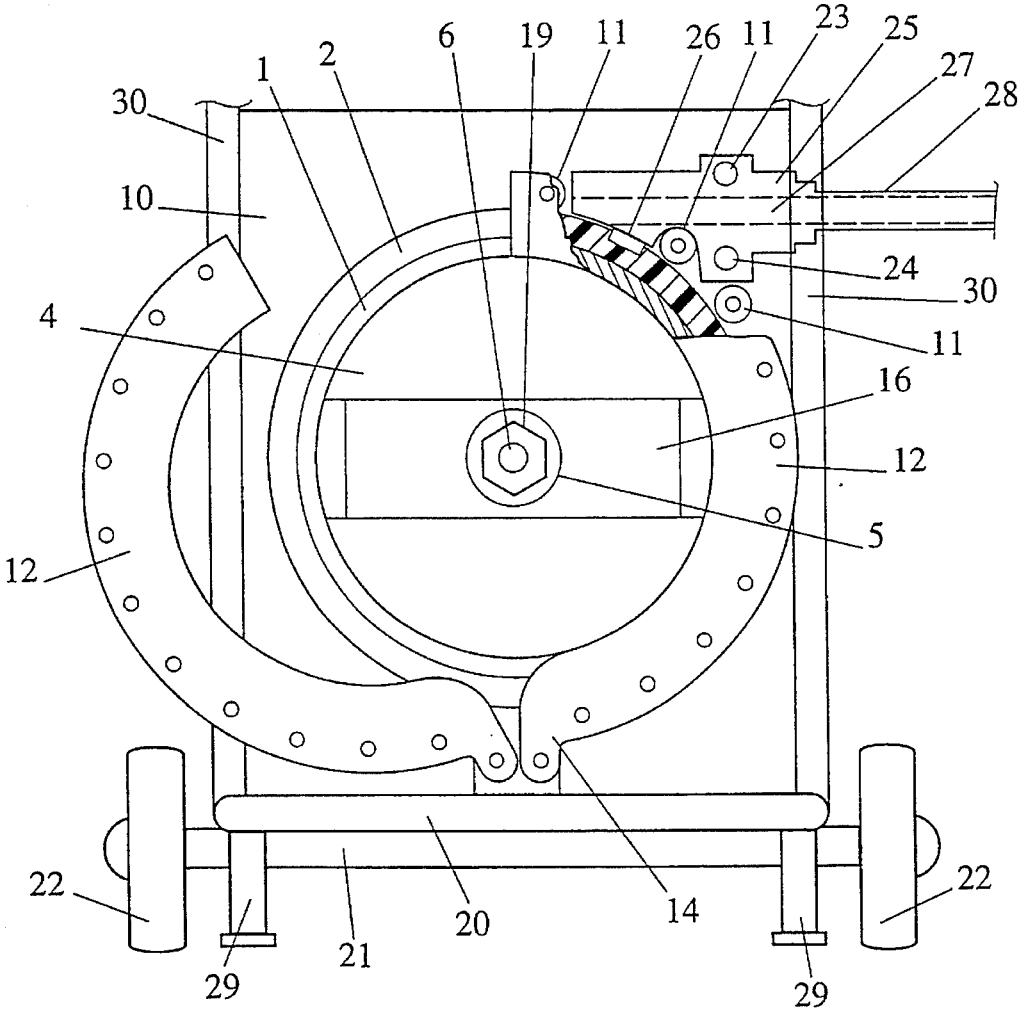
FIG. 2 is a view of the apparatus of FIG. 1 from the non driven end of the drum showing one half of the roller cage opened and with certain parts sectioned.

With reference to FIGS. 1 and 2, drum 1 is provided with a jacket 2 of some suitable hard elastomeric material in which spiral groove 3 is formed. The depth of said spiral groove is such that a cleaning lance, survey unit umbilical cable or the like (not shown) is more or less completely accommodated within said groove. The width of said groove is made such that said lance, umbilical cable or the like is frictionally captured within said groove when it is rolled into said groove by the action of one or more of said rollers and is thus restrained from circumferential movement relative to said drum. Said drum is provided with circular internal web 4, at the centre of which is situated boss 5, said boss being pierced with a bore shaped to engage splines or other complementary shapes on the end 6 of drive shaft 7. Said drum is secured to the end of said shaft with nut 19. Said drive shaft is rotationally supported in self aligning bearing 9 (depicted symbolically) which is fixed to support plate 10. Said drive shaft may extend out through said self aligning bearing and be driven in a rotational sense by suitable externally positioned drive means or, as in the preferred embodiment, may terminate at said bearing and be driven by an internally housed drive means (not shown) driving a sprocket wheel or pulley 8 on shaft 7 through suitable chains or belts (not shown). Control means (not shown) are provided to allow precise control of rotational movement of said drum.

Said drum is enclosed by a plurality of axially disposed rollers 11 arranged to form a cylindrical cage, the two ends of said rollers being rotationally supported in roller support members 12 and 13. Said roller support members are pivotally supported respectively in brackets 14 and 15 attached to frame 20 and are adapted to be opened so as to allow removal of drum 1 from the apparatus. Abutting unsupported ends of said roller support members are provided with adjustable connection means (not shown) to permit said unsupported ends to be positively clamped one to another such that said roller cage is urged into its closed position in which said rollers apply pressure to maintain said lance, umbilical cable or the like in groove 3 formed in jacket 2 of drum 1. The pressure applied by said rollers upon said lance, umbilical cable or the like is regulated by adjustment of said connection means.

Attached to internal web 4 of said drum is diametrally disposed bracket 16 to which, on the axis of shaft 7, is fixed entry fitting 17. To the outer end of said entry fitting (shown cut away) through suitable swivel joint means (not shown) is connected, as appropriate, high pressure water hosing, electrical cabling or the like and said lance, umbilical cable or the like is brought through a suitable opening (not shown) in said drum and connected to inner end 18 of-said entry fitting.

Slidably supported on one or more axially disposed rails 24 fixed to the structure of said apparatus outside of said roller cage is a guide member in the form of a terminal block 25 upon which is supported the proximal end of a tangentially arranged guide tube 28. Said lance, umbilical cable or the like is led from said drum out through a bore 27 (indicated in broken line in FIG. 2) in the guide member or terminal block 25 and thence to said guide tube 28. The guide tube 28 may be made of a flexible material or may include one or more flexible zones or joints so that an operator can direct a free end of the tube 28 to the adjacent end of any tube in an array of such tubes to be worked upon. Alternatively mechanical positioning means might be used to position the distal end of the guide tube 28 as desired. The guide member or block 25 is provided with a tongue 26 projecting radially inwardly to engage the groove in the drum such that rotation of the drum causes the terminal block to be axially displaced along said rails and thus maintained in alignment with the point at which said lance, umbilical cable or the like exits from or re-enters said groove in said drum. The peripheral spacing of rollers 11 is increased at the point at which said terminal block extends between them.

Frame 20 is provided at its end adjacent to said drum drive means with axle 21, to the ends of which are rotationally fixed wheels 22 to allow ease of movement of said apparatus. Said frame is provided at its end adjacent to entry fitting 17 with one or more short legs 29 to maintain the axis of said drum in a more or less horizontal attitude. Frame 20 is extended vertically above said axle to form handle members 30. Support plate 10 is attached to frame 20 at its lower edge and the outer edges of returns 31 on each of its sides are fixed to said handle members. The space between the outer surface of said support plate and the inner surfaces of its said returns provides accommodation for valves and the like by means of which said apparatus is controlled, said accommodation being closed by a sheet of suitable material (not shown) being fixed over it between handle members 30. The two halves of said roller cage of said apparatus are enclosed by covers (not shown) of some suitable sheet material passing around them and fastened to the peripheral edges of roller support members 12 and 13.

In operation, with said lance, umbilical cable or the like fully wound in said groove on said drum, controls are operated to motivate said drive means and rotationally drive said drum. Said lance, umbilical cable or the like is extended out through bore 27 in said terminal black and through guide tube 28 to a tube or conduit to be cleaned or surveyed. High pressure water or electrical current is connected to said lance, umbilical cable or the like through suitable swivel joint means attached to entry fitting 17. Suitable means are proved to register rotational movement of said drum and provide feedback to control means to automatically regulate speed and length of extension of said lance, umbilical cable or the like. Retraction of said lance, umbilical cable or the like is the reverse of the foregoing.

What is claimed is:

1. Apparatus for storing and selectively projecting a flexible lance therefrom, said apparatus comprising a drum storage means for storing said lance in a plurality of wound coils thereon with a distal end of said lance being adapted to project from said apparatus, drive means enabling rotation of said drum storage means about a rotation axis to extend said distal end from said drum storage means or to retract said distal end towards said drum storage means, said apparatus being characterized by restraining means located circumferentially around said drum storage means to engage and maintain said lance in position on said drum storage means when withdrawn thereon, said apparatus being further characterized by guide means having a proximal end adjacent said drum storage means and a distal end spaced from said proximal end, said guide means defining a path from said proximal end to said distal end through which said flexible lance passes during extension from or withdrawal onto said storage means, said guide means being mounted for bodily movement in a direction parallel to the rotation axis of said storage means in response to rotation of said storage means whereby said path at said proximal end of the guide means remains coincident with the direction of said flexible lance as it is extended from or as it is withdrawn onto said drum storage means, and said drum storage means further including a circumferential region formed from an elastomeric material with a spirally formed groove in an outer peripheral surface thereof, said groove having a width such that said lance is positionable in said groove with an interference fit.

2. Apparatus according to claim 1, wherein guide rail means is provided to maintain said path at said proximal end of the guide means coincident with the direction of said flexible lance as it is extended from or as it is withdrawn onto said drum storage means as said guide means is bodily moved.

3. Apparatus according to claim 2, wherein said guide rail means comprises a pair of guide rails cooperable with said guide means, said guide rails being spaced from one another and arranged parallel to the rotation axis of said drum storage means.

4. Apparatus according to claim 1, characterized in that said guide means cooperates with said groove to move said guide means in the direction parallel to the rotation axis of said drum storage means.

5. Apparatus according to claim 1, wherein said restraining means comprises a plurality of axially extending rollers circumferentially spaced about said drum storage means and adapted to engage said lance when said lance is positioned on said drum storage means at least one of said rollers being located adjacent the proximal end of said guide means to roll said lance into said groove.

6. Apparatus according to claim 1, wherein said restraining means comprises at least two sections with one of said sections being selectably movable from a first position engaging said wound coils on the storage means to a second position substantially spaced from said storage means to give access to said storage means.

7. Apparatus according to claim 6 wherein said restraining means comprises a plurality of rollers extending over an axial length sufficient to engage all the wound coils when said lance is fully withdrawn onto said drum storage means, said rollers forming a restraining cage surrounding said storage means when said sections are located in the first position.

8. Apparatus for storing and selectively projecting a flexible lance therefrom, said apparatus comprising a drum storage means having at least a circumferential region formed from an elastomeric material with a spiral groove formed therein whereby said flexible lance is stored in said groove with an interference fit between said groove and said lance with a distal end of said lance being adapted to project from said apparatus, drive means enabling rotation of said storage means about a rotation axis to extend said distal end from said storage means or to retract said distal end towards said drum storage means, said apparatus further including restraining means located circumferentially around said storage means to engage and maintain said flexible lance within said spiral groove when withdrawn onto said drum storage means, and guide means through which said lance passes during extension from or withdrawal onto said drum storage means, said guide means being mounted for movement in a direction parallel to the rotation axis of said storage means in response to rotation of said storage means.

* * * * *